US005553853A

United States Patent [19]

Sackitey

[11] Patent Number: 5,553,853

[45] Date of Patent: Sep. 10, 1996

[54] GAME APPARATUS AND METHOD OF PLAY FOR TEACHING DNA RELATED TECHNOLOGIES

[76] Inventor: Solomon K. Sackitey, 1011 New Hope St. Apt. 18c, Norristown, Pa. 19401

[21] Appl. No.: 520,315

[22] Filed: Aug. 28, 1995

[51] Int. Cl.[6] ..... A63F 3/00

[52] U.S. Cl. ..... 273/236; 273/143 R

[58] Field of Search ..... 273/236, 242, 273/243, 240, 138 R, 139, 142 R, 143 R; 434/128, 129

[56] References Cited

U.S. PATENT DOCUMENTS 3,423,093 1/1969 LaHav .
3,594,923 7/1971 Midgley .
3,594,924 7/1971 Baker .

*Primary Examiner*—William E. Stoll
*Attorney, Agent, or Firm*—LaMorte & Associates

[57] ABSTRACT

A game apparatus and an asociated method of play that educates the players about DNA related technologies. The game includes a selector for selecting a nucleotide from a group of nucleotides normally associated with DNA. By randomly selecting nucleotides and recording the selected nucleotides, each player creates a unique DNA sequence. The DNA sequence is used in one of a variety of game motifs to determine the winner of the game.

18 Claims, 7 Drawing Sheets

FIG-3

| SS | A (75) | C (76) | T (77) | G (78) | U (79) | SS |
|---|---|---|---|---|---|---|
| 00 | 3' FINISH (73) | | | | | 00 |
| 25 | | | | | | 25 |
| 24 | | deAMPLIFY 2x | | deAMPLIFY 2x | AMPLIFY 2x | 24 |
| 23 | AMPLIFY 2x | | deAMPLIFY 2x | AMPLIFY 2x | REPLICATE | 23 |
| 22 | REPLICATE | | | REPLICATE | deAMPLIFY 2x | 22 |
| 21 | deAMPLIFY 3x | AMPLIFY 3x | REPLICATE | AMPLIFY 2x | | 21 |
| 20 | BONUS SPIN | BONUS SPIN | AMPLIFY 2x | BONUS SPIN | AMPLIFY 2x | 20 |
| 19 | AMPLIFY 2x | deAMPLIFY 2x | BONUS SPIN | AMPLIFY 2x | BONUS SPIN | 19 |
| 18 | | REPLICATE | AMPLIFY 3x | | AMPLIFY 2x | 18 |
| 17 | AMPLIFY 3x | AMPLIFY 2x | | deAMPLIFY 3x | | 17 |
| 16 | BONUS SPIN | deAMPLIFY 3x | | REPLICATE | deAMPLIFY 2x | 16 |
| 15 | deAMPLIFY 2x | AMPLIFY 2x | deAMPLIFY 2x | AMPLIFY 4x | | 15 |
| 14 | AMPLIFY 3x | BONUS SPIN | REPLICATE | | AMPLIFY 3x | 14 |
| 13 | deAMPLIFY 2x | deAMPLIFY 2x | BONUS SPIN | AMPLIFY 2x | BONUS SPIN | 13 |
| 12 | AMPLIFY 2x | REPLICATE | AMPLIFY 2x | BONUS SPIN | | 12 |
| 11 | AMPLIFY 4x | | deAMPLIFY 3x | | | 11 |
| 10 | deAMPLIFY 2x | AMPLIFY 4x | deAMPLIFY 2x | deAMPLIFY 2x | deAMPLIFY 3x | 10 |
| 9 | REPLICATE | | AMPLIFY 2x | | REPLICATE | 9 |
| 8 | | AMPLIFY 2x | AMPLIFY 3x | AMPLIFY 3x | AMPLIFY 4x | 8 |
| 7 | AMPLIFY 2x | deAMPLIFY 2x | BONUS SPIN | BONUS SPIN | AMPLIFY 2x | 7 |
| 6 | BONUS SPIN | REPLICATE | deAMPLIFY 2x | AMPLIFY 3x | BONUS SPIN | 6 |
| 5 | REPLICATE | | AMPLIFY 2x | | deAMPLIFY 2x | 5 |
| 4 | deAMPLIFY 2x | AMPLIFY 2x | | deAMPLIFY 2x | | 4 |
| 3 | | BONUS SPIN | AMPLIFY 4x | | deAMPLIFY 2x | 3 |
| 2 | | AMPLIFY 3x | | | REPLICATE | 2 |
| 1 | | | REPLICATE | REPLICATE | AMPLIFY 3x | 1 |
| 00 | 5' START (74) | | | | | 00 |
| SS | A | C | T | G | U | SS |

70 72 86 85 82 80

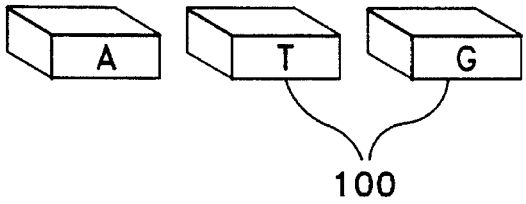

FIG-7

200

| "SUSPECT" # | Position of Amino Acid in the Sequence | | | | | | | | | |
|---|---|---|---|---|---|---|---|---|---|---|
| | 1 | 2 | 3 | 4 | 5 | 6 | 7 | 8 | 9 | 10 |
| 1 | Y | A | K | Q | T | Z | M | R | C | C |
| 2 | D | I | C | K | S | R | A | M | M | Y |
| 3 | H | A | W | A | I | I | Q | S | | |
| 4 | G | H | A | N | A | K | R | N | B | I |
| 5 | V | I | M | K | L | I | S | | | |
| 6 | S | H | A | M | E | | | | | |
| 7 | Y | A | K | Q | T | Z | M | K | C | C |
| 8 | M | I | C | K | S | H | A | M | M | Y |
| 9 | H | A | W | A | I | T | Q | S | | |
| 10 | T | A | T | A | | | | | | |

GAME APPARATUS AND METHOD OF PLAY FOR TEACHING DNA RELATED TECHNOLOGIES

BACKGROUND OF THE INVENTION

1. Field of the Invention

The present invention is a game apparatus and an associated method of play that is intended to educate the game's players about the sciences associated with DNA technology/biotechnology and how those sciences are used, among other things, to identify specific people, diseases and the like.

2. Prior Art Description

It is well known that people learn more efficiently if the learning experience is enjoyable and enables the person being taught to actively participate in the learning process. It is for this reason that educators have often created games that embody the subject that is to be taught. By having people play the game, the target information is taught to the players in a fun, entertaining and interactive manner. The prior art record is replete with games that are intended to teach their players different subjects. Many such games teach the fundamentals of education such as reading, arithmetic, geography and the like. However, much fewer games are directed toward the more advanced sciences such as chemistry and biology. The few games that are associated with the more advanced sciences teach only one aspect of that science and often do not explain any real life application for that science. For instance, in U.S. Pat. No. 3,423,093 to LaHav, entitled GAME BOARD AND PLAYING PIECES FOR A GAME ADAPTED TO TEACH CHEMISTRY, a game is disclosed that is intended to teach the periodic chart of elements. Although the game is effective in teaching how the periodic chart is organized and how it is referenced, the game gives no explanation of how the periodic chart or chemistry in general is used in everyday life. Without the association of the learned material to everyday life, students often have a hard time relating to the learned material, and therefore do not show much interest.

Of all the more advanced sciences, few have been advancing as rapidly as have the sciences related to biotechnology. Within the biotechnology field, DNA sequence analysis seems to be having a large effect on everyday society. DNA technology is being used to identify criminals in murder cases by matching blood samples to suspects. DNA technology is also being used to identify disease-causing genes. Both applications for DNA technologies are well advertised in the news, however the actual science involved in the use of DNA is unknown to the vast majority of people. The sciences involved in DNA biotechnology are fairly complex and have been traditionally reserved to specific college level courses. As such, the teaching aids used within these courses were intended for lecture demonstrations by a teacher in front of a classroom and were not intended for entertainment or player participation. Such prior art teaching aids are exemplified by U.S. Pat. No. 3,594,924 to Baker, entitled DNA-RNA TEACHING AID. In the Baker patent, a demonstrative model of a strand of DNA is provided. Although useful for visualization purposes in support of a lecture on DNA, the model has little entertainment value of its own.

A need, therefore, exists for an entertaining game and method of play for educating people about the technologies associated with DNA. The need also exists for a game that explains DNA technologies to students who have not yet achieved a college level education. Therefore, the game and method of play must be simple to understand and entertaining to play.

It is therefore an object of the present invention to provide a game and method of play that teaches DNA technologies in a manner that is easy to understand, entertaining to play and utilizes real life applications to engage the attentions and interests of the players as they play.

SUMMARY OF THE INVENTION

The present invention is a game and an associated method of play that educates the players about DNA related technologies. The game includes a means for randomly selecting nucleotides in the form of amino acids, restriction enzymes or the like from a larger selection grouping. Each nucleotide available for selection is added to a DNA sequence. By randomly selecting nucleotides and recording the nucleotide, each player creates a unique DNA sequence. The DNA sequence is used in one of a variety of game motifs to determine the winner of the game. For instance, the player with the longest DNA sequence, having the least number of STOP codons, may win. Alternatively, point values may be determined for specific DNA sequence fragments, wherein the player with the highest point value wins. In yet another embodiment, the players may be given DNA sequences that correspond to various "SUSPECTS". The game is then won by creating a DNA sequence that identifies one of the "SUSPECTS".

BRIEF DESCRIPTION OF THE DRAWINGS

For a better understanding of the present invention, reference is made to the following description of an exemplary embodiment thereof, considered in conjunction with the accompanying drawings, in which:

FIG. 3 is a top view of one preferred embodiment of the game board used in association with one method of play described;

FIG. 7 is a top view of an exemplary version of a SUSPECT DNA IDENTIFICATION SHEET used in association with an alternate method of play described.

DETAILED DESCRIPTION OF THE INVENTION

Figure 1:
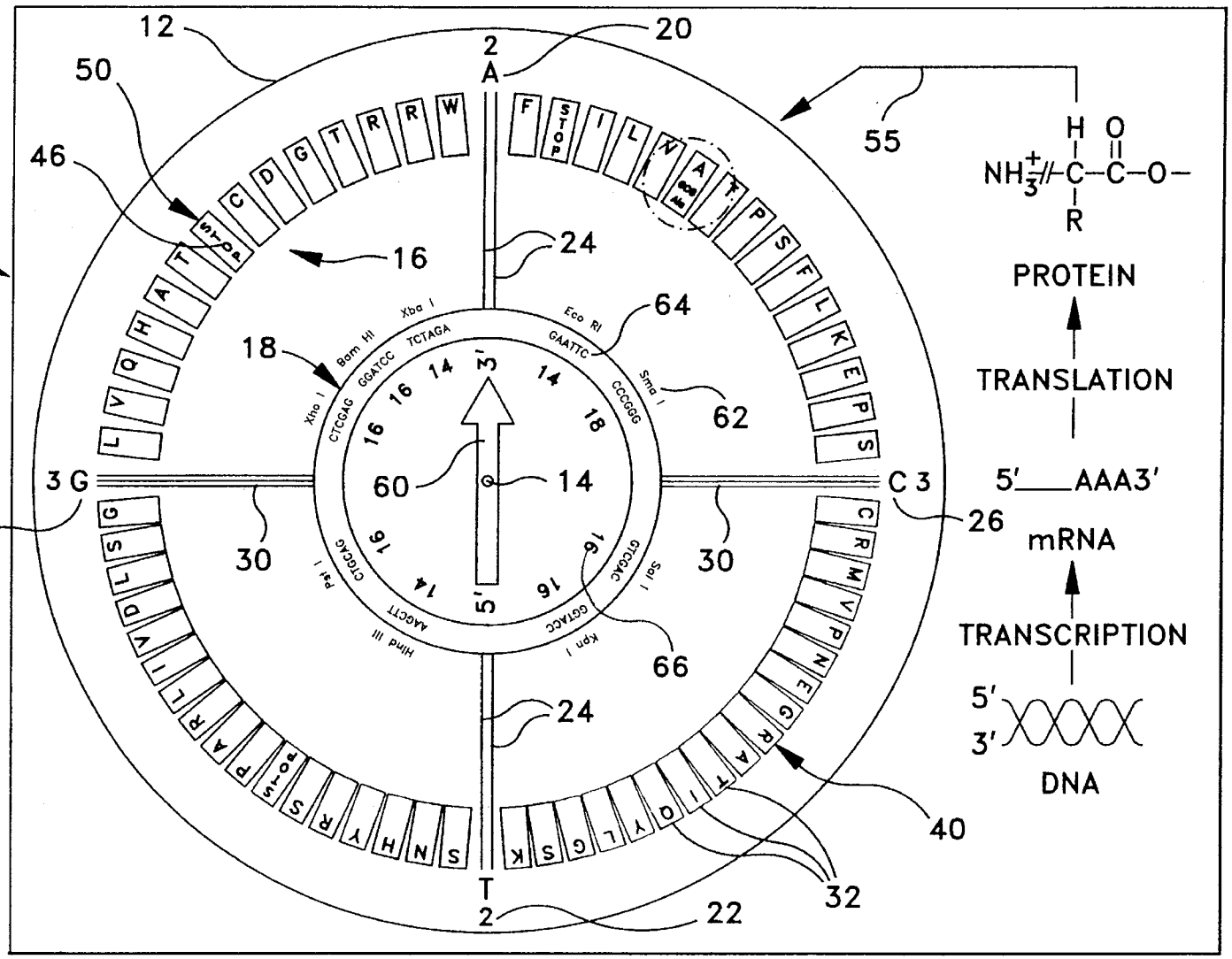
FIG. 1 is a top view of one preferred embodiment of the random amino acid selection means formed into the configuration of a rotatable chance wheel with a stationary indicator arrow.

The present invention is a game and method of play that educates the players about various science-based technologies associated with the structure and use of deoxyribonucleic acid (DNA) and the genetic code. Although the preferred embodiment described below utilizes the format of a board game, it will be understood that the game and the method of play can be adapted to other formats, such as that of a computer game. As will be explained, the game has been designed to introduce the non-science audience and school children to DNA technologies. The basis of the game explains to the players the fundamental principles of gene expression technology and recombinant DNA technology. Therefore, by playing the game, the players learn about the genetic code, the names of amino acids within genes, the names, recognition sequences and restriction sites of DNA restriction enzymes, as well as a basic understanding of DNA sequence analysis, gene amplification, transcription, translation and base pairing by hydrogen bonding. Each of these technologies is taught in the course of a game where the objective of the game, depending upon the method of play, is to create the longest DNA sequence or use DNA testing to find a "SUSPECT". Depending upon the game, the "SUSPECT" could be a criminal, a lost relative, a genetic disease, a genetic defect, an environmental pollutant or fictional gene mutating element such as an alien mutator bug.

DNA is a double helix structure comprised of four basic building blocks. Those blocks are Guanine, Adenine, Cytosine and Thymine. For the purposes of this disclosure, the four building blocks will be referred to as nucleotides. In the double helix of DNA, Guanine joins to Cytosine with a triple hydrogen bond, wherein the Guanine-Cytosine base pair is called a pyrimidine. Adenine joins to Thymine with a double hydrogen bond, wherein the Adenine-Thymine base pair is called a purines. In the genetic code, the various building blocks join together in various ways to form one of over twenty different amino acids. Referring to the Table I below, it can be seen that each amino acid has a full name, a three-letter code, a one-letter code and at least one triplet codon sequence, wherein the triplet codon sequence is a sequence of three of the four building blocks, i.e. Guanine, Adenine, Thymine, and Cytosine, which are represented by the letters "G", "A", "T" and "C", respectively.

As can be seen, each of the amino acids listed in Table I is identified by at least one triplet codon sequence. Many of the amino acids have multiple triplet codons, all of which define the amino acid with the stated name. For instance, the first amino acid listed in Table I is Alanine. Alanine is also identified by four triplet codons, namely a Guanine-Cytosine-Guanine (GCG) triplet, a Guanine-Cytosine-Adenine (GCA) triplet, a Guanine-Cytosine-Thymine (GCT) triplet and a Guanine-Cytosine-Cytosine (GCC) triplet. As will later be explained, each of the triplet codons comprising a given amino acid is used within the game.

Referring now to FIG. 1, a preferred embodiment of a random amino acid selection device 10 is shown. In the shown embodiment, the random amino acid selection device 10 is a chance wheel 12 that is rotatable around a pivot 14 at its midpoint. The chance wheel 12 is comprised of two concentric rings 16, 18. In FIG. 1, the large outer ring 16 on the chance wheel 12 is segmented into four sections. At the twelve o'clock position there is positioned a large letter "A" (20), that is indicative of the building block element Adenine. At the six o'clock position there is a large letter "T" (22), that is indicative of the building block element Thymine. Two large lines 24 extend through the outer ring 16 from the letter "A" (20) to the letter "T" (22). The two lines are indicative of the double hydrogen bond that holds Adenine to Thymine in a DNA molecule structure. A value of two is assigned to both the letters "A" (20) and "T" (22), indicating that "A" and "T" are held together by two hydrogen bonds within the structure of the DNA molecule.

At the three o'clock position on the chance wheel 12 is a large letter "C" (26), that is indicative of the building block element Cytosine. At the opposite nine o'clock position on the chance wheel 12 is a large letter "G" (28) that is indicative of the building block element Guanine. Three large lines 30 extend through the outer ring 16 from the letter "C" (26) to the letter "G" (28). The three lines represent the triple hydrogen bond that couples Guanine to Cytosine in a DNA sequence segment. A value of three is assigned to both the letters "G" (28) and "C" (26), indicating that "G" and

TABLE I

| Amino Acid | Three-Letter Code | One-Letter Code | Triplet Codon Sequence (5' -----<<<<< 3') | # of Triplet Codons |
|---|---|---|---|---|
| Alanine | Ala | A | GCT, GCC, GCA, GCG | 4 |
| Asparagine &/or Aspartic acid | Asx | B | AAT, AAC/GAT, GAC | 2/4/2 |
| Cysteine | Cys | C | TGT, TGC | 2 |
| Aspartic acid | Asp | D | GAT, GAC | 2 |
| Glutamic acid | Glu | E | GAA, GAG | 2 |
| Phenylalanine | Phe | F | TTT, TTC | 2 |
| Glycine | Gly | G | GGT, GGC, GGA, GGG | 4 |
| Histidine | His | H | CAT, CAC | 2 |
| Isoleucine | Ile | I | ATT, ATC, ATA | 3 |
| Lysine | Lys | K | AAA, AAG | 2 |
| Leucine | Leu | L | TTA, TTG, CTT, CTC, CTA, CTG | 6 |
| Methionine | Met | M | ATG | 1 |
| Asparagine | Asn | N | AAT, AAC | 2 |
| Proline | Pro | P | CCT, CCC, CCA, CCG | 4 |
| Glutamaine | Gln | Q | CAA, CAG | 2 |
| Arginine | Arg | R | CGT, CGC, CGA, CGG, AGA, AGG | 6 |
| Serine | Ser | S | TCT, TCC, TCA, TCG, AGT, AGC | 6 |
| Threonine | Thr | T | ACT, ACC, ACA, ACG | 4 |
| Valine | Val | V | GTT, GTC, GTA, GTG | 4 |
| Tryptophan | Trp | W | TGG | 1 |
| Tyrosine | Tyr | Y | TAT, TAC | 2 |
| Glutamine &/or Glutamic acid | Glx | Z | CAA, CAG/GAA, GAG | 2/4/2 |

"C" are held together by three hydrogen bonds within the structure of the DNA molecule.

Figure 2:
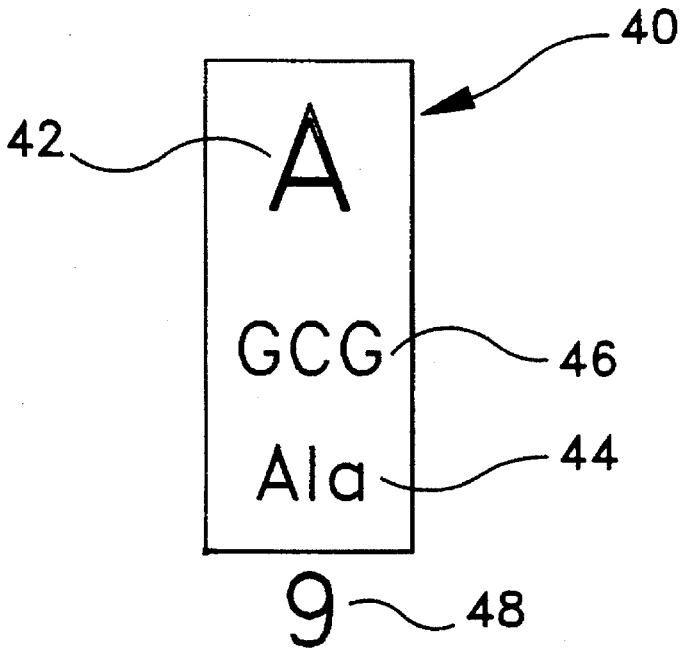
FIG. 2 is an enlarged view of the segment of FIG. 1 contained within circle 2 as shown in FIG. 1.

The large outer ring 16 on the chance wheel 12 is comprised mostly of rectangular icons 32 that are radially disposed around the midpoint of the chance wheel 12. In the shown embodiment, there are over sixty rectangular icons 32, however it should be understood that a greater or smaller number can also be used. There are two types of rectangular icons 32 represented on the outer ring 16 of chance wheel 12. Between 60%–95% of the rectangular icons 32 are amino acid icons 40. Referring to FIG. 2, it can be seen that each amino acid icon 40 includes a one letter code 42, a three letter code 44, and a triplet codon sequence 46. The one letter code 42, three letter code 44 and triplet codon sequence 46 are all taken from the same line in Table I. For example, in FIG. 2 the one letter code 42 is the letter A. The three letter code 44 is the letter sequence Ala and the triplet codon sequence 46 is GCG. Each of these variables was taken from the first line of Table I. It should be understood that although the same one letter code 42 and three letter code 44 may appear in different amino acid icons 40 on the chance wheel 12, the triplet codon sequence 46 is preferably unique to a single icon. Since most of the amino acids listed in Table I have multiple triplet codon sequences, multiple usages of each amino acid is possible without repeating the triplet codon sequence.

Below each of the amino acid icons 40 is listed a numerical value 48. The numerical value 48 is determined by the triplet codon sequence 46 contained within the icon. As has been previously explained, each of the letters "A" (20) and "T" (22) at the top and bottom of the chance wheel 12 (FIG. 1) were given the value of two, while the letters "G" (28) and "C" (26) were each given the value of three. Using these arbitrary values, the numerical value 48 for each amino acid icon 40 is determined. For instance, in FIG. 2 the three letter code 44 is GCG. Since "G" and "C" are both given a value of three, the value of GCG is 3+3+3=9. Accordingly, the numerical value 48 below the amino acid icon 40 is provided the value nine.

Returning to FIG. 1, it can be seen that in addition to the majority of amino acid icons 40, STOP icons 50 are also contained within the outer ring 16 of the chance wheel 12. The STOP icons 50 also contain a triplet codon sequence 46. However, the triplet codon sequence 46 selected from the grouping of TAA, TAG or TGA. These triplet codon sequences 46 are known as STOP codons or NONSENSE codons in DNA gene expression analysis. Each of the amino acid icons 40, however, contain triplet codon sequences commonly known as SENSE codons. SENSE codons are the primary building blocks of proteins. STOP codons result in the termination of translation, thereby stopping the production of any regular amino acid. For the purposes of this game, the STOP icons 50 are each provided with a numerical value of zero.

An indicator arrow 55 is disposed proximate the chance wheel 12. As the chance wheel 12 is spun, the indicator arrow 55 randomly points to whichever of the rectangular icons 32 comes to rest adjacent the indicator arrow 55. The indicator arrow 55 as shown illustrates the basic steps of gene expression. Beginning with a DNA sample, the DNA is converted to RNA through a process referred to as "Transcription". The RNA is then converted into proteins through a process known as "Translation". By convention, a DNA strand "starts" (i.e. runs) from a 5' end to a 3' end. Usually, the top strand (i.e. the SENSE strand) in the double-stranded DNA molecule runs in a 5' to 3' direction. Adversely, the lower, ANTISENSE strand runs in a 3' to 5' direction. Throughout the game, the nomenclature of 5' and 3' are used to illustrate the creation of SENSE strands that run in the 5' to 3' direction. It will be understood that instead of having a rotating chance wheel and a stationary arrow as is depicted, a rotating arrow with a stationary wheel can be easily substituted with the same results.

A rotating arrow 60 is contained in the center of the chance wheel 12. The rotating arrow 60 is sized to point to a position on the smaller inner ring 18 of the chance wheel 12 when spun. The smaller inner ring 18 is divided into nine regions, however, fewer or more regions could be used if desired. Each of the nine regions of the smaller inner ring 18 is identified by a DNA restriction enzyme name 62 and a recognition sequence 64. The enzyme name 62 corresponds to one of the DNA restriction enzymes listed below in Table II. As is well known in DNA related sciences, restriction enzymes selectively cut DNA strands at certain sequence junctions. As is shown by Table II, the point at which each enzyme cuts a predetermined sequence is shown in Table II by an asterisk (*).

TABLE II

| Restriction Enzyme | Recognition Sequence |
|---|---|
| Eco RI | G*AATTC |
| Sma I | CCC*GGG |
| Sal I | G*TCGAC |
| Kpn I | GGTAC*C |
| Hind III | A*AGCTT |
| Pst I | CTGCA*G |
| Xho I | C*TCGAC |
| Bam HI | G*GATCC |
| Xba I | T*CTAGA |

As can be seen from FIG. 1, each enzyme located on the inner ring 18 also has a numerical value 66 associated therewith. The numerical value is dependent upon the recognition sequence and is used during the play of the game as will later be explained.

Referring to FIG. 3, a preferred embodiment of the game board 70 is shown. The game board 70 is laid out as a grid, wherein a plurality of identically sized playing spaces 72 are arranged in parallel rows and columns. The columns extend between a common START box 74 and a common FINISH box 73, representing the respective 5' and 3' ends of a DNA sequence. In the shown embodiment, there are five columns 75, 76, 77, 78, 79, however it should be understood that the number of columns corresponds to the maximum number of players. As a result, more or less columns could be used. Also in the shown embodiment, there are twenty five rows. This number is also arbitrary and any greater or lesser number of rows could be used. In each of the columns 75, 76, 77, 78, 79, there are six different types of playing spaces dispersed among the various rows. The six different playing spaces include blank spaces 80, "REPLICATE" spaces 82, "BONUS SPIN" spaces 84, "AMPLIFY" spaces 85 and "deAMPLIFY" spaces 86. The "AMPLIFY" spaces and "deAMPLIFY" spaces contain exponential functions of $N^x$ where N is two, three or four.

Figure 4:
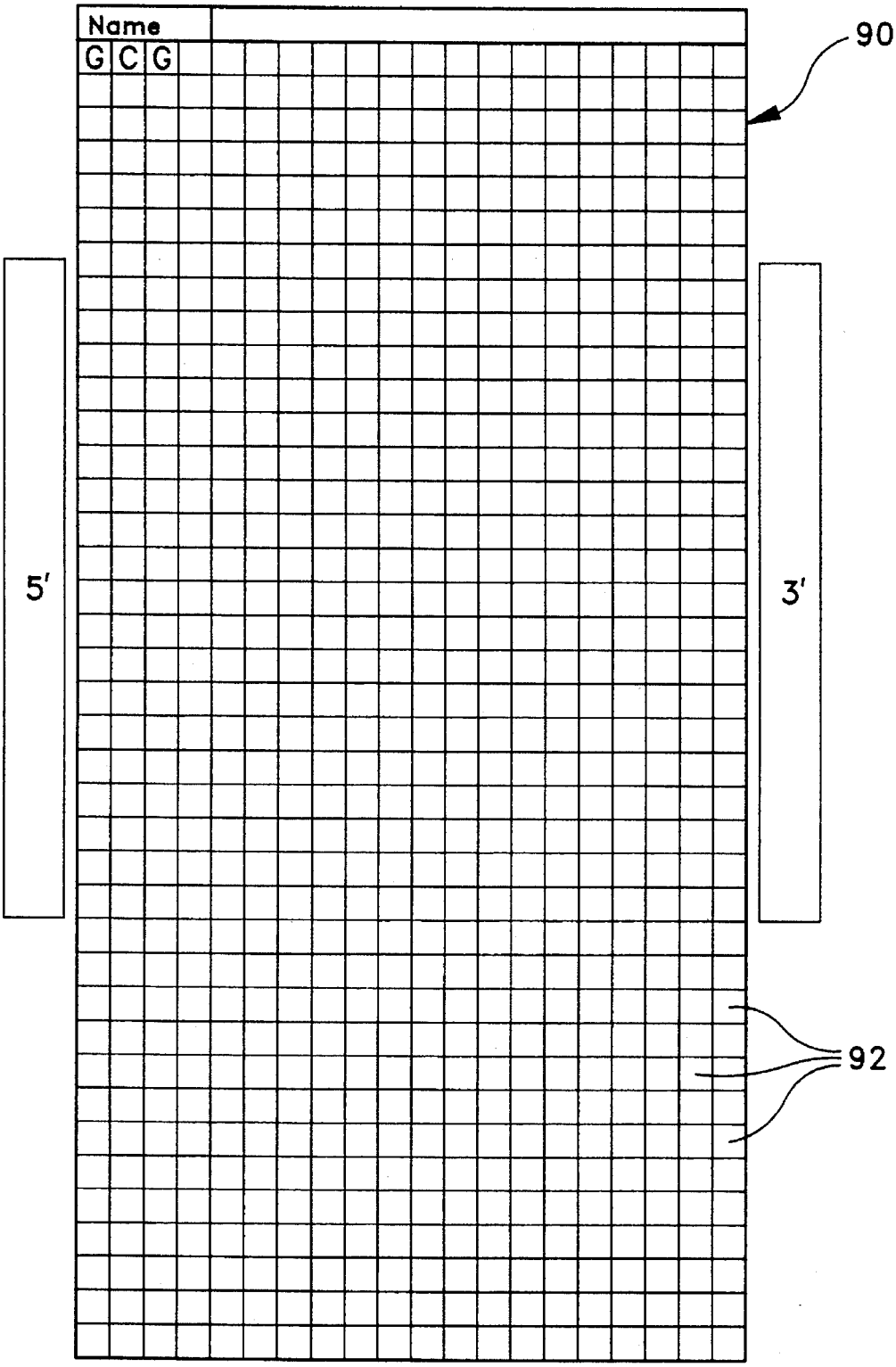
FIG. 4 is a top view of a DNA SEQUENCE SCORE CARD used in association with one method of play described.

Referring to FIG. 4, a preferred embodiment of the DNA SEQUENCE SCORE CARD 90 is shown. This score card 90 is comprised of a plurality of columns and rows of blank spaces 92, wherein each of the blank spaces 92 is large enough for a player to write a letter therein. A space is also provided at the top of the score card 90 for a player to write his/her name.

Figure 5:
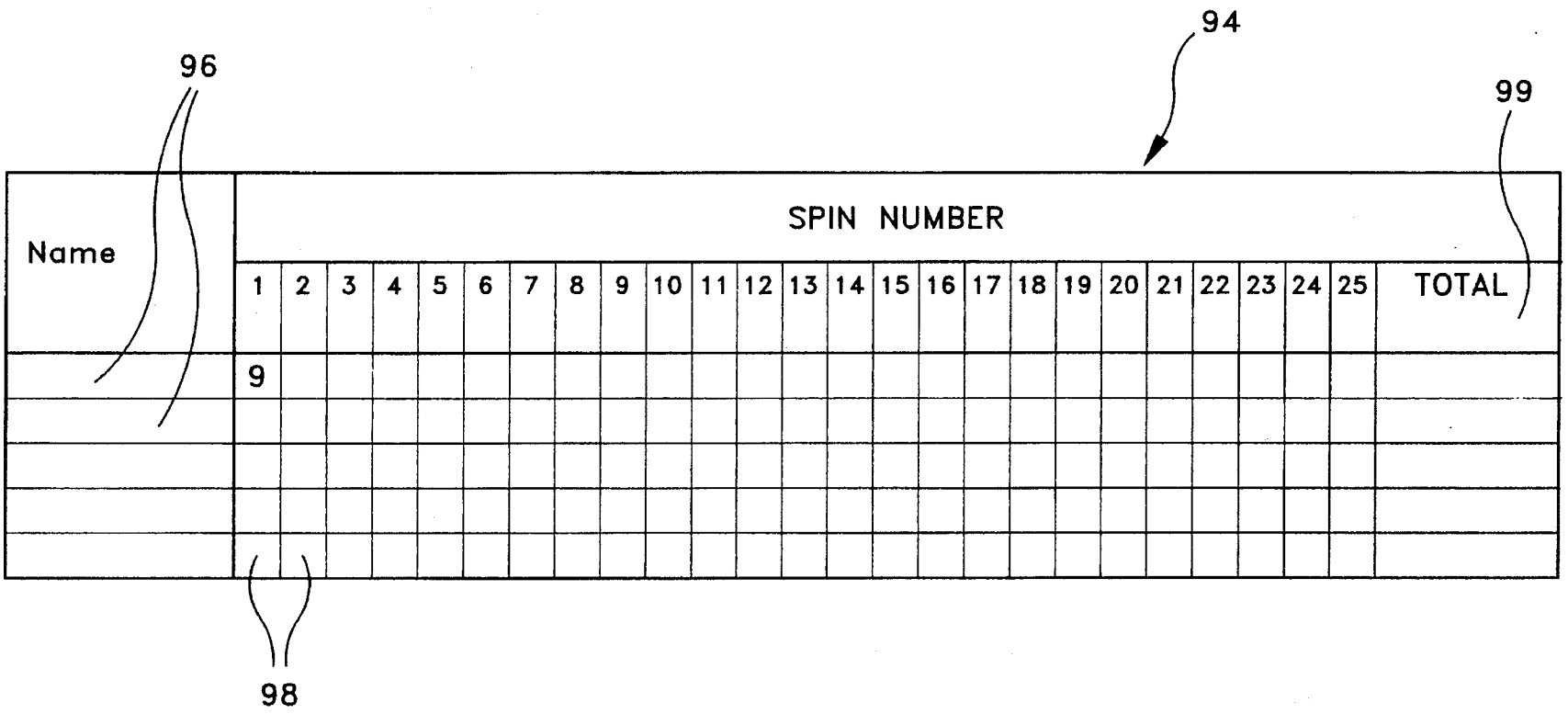
FIG. 5 is a top view of an AMPLIFICATION POINT SCORE CARD used in association with one method of play described.

Referring to FIG. 5, a preferred embodiment of the AMPLIFICATION POINTS SCORE CARD 94 is shown. The score card 94 is arranged as a matrix where each player is assigned a row 96 and the columns 98 correspond in number to the number of rows on the game board 70 (FIG. 3). A "TOTAL" column 99 is also provided, wherein a player's final score can be displayed.

Method of Play No. 1

Referring simultaneously to FIGS. 1–5, the preferred method of play can be explained. To set up the game for play, each player is given a game piece 100 (FIG. 3) The game pieces 100 can be any icon that is distinguishable from the others by either its color or shape. To start the game, each player places his/her playing piece 100 in the START box 74 on the game board 70 (FIG. 3). After deciding which player will go first, each player is assigned one of the columns 75, 76, 77, 78, 79. The initial player then advances his/her playing piece into the first row of the column assigned to that player. Once advanced into the proper row, the player can spin the chance wheel 12 (FIG. 1). In FIG. 1, the indicator arrow 55 is pointing to an amino acid icon 40 having a one letter code 42 A, a triplet codon sequence 46 "GCG" and a numerical value 48 of "9". The player writes the triplet codon sequence 46 of "GCG" into the first three boxes of the DNA SEQUENCE SCORE CARD 90 (FIG. 4).

The number written into the first box of the AMPLIFICATION POINTS SCORE CARD 94 (FIG. 5) is dependent upon the indicia written into the playing space on the game board 70 (FIG. 3). If the playing space is a blank space 80, then the numerical value (i.e. "9") from the chance wheel 12 (FIG. 1) is written into the first box on the AMPLIFICATION POINTS SCORE CARD 94, thereby giving the player a score of "9". However, if the playing space landed upon were an "AMPLIFY" space 85, then the numerical value (i.e. "9") obtained from the chance wheel 12 would be substituted for "x" in the exponential function $N^x$ written in the space. For example, if a player landed on a space that said "AMPLIFY $2^x$" then the value "9" would be substituted for "x" and the player would receive a score equivalent to $2^9$=512. The value of "512" would then be entered onto the AMPLIFICATION POINTS SCORE CARD 94 (FIG. 5).

Alternatively, if the player were to land upon a "deAMPLIFY" space then the numerical value (i.e. "9") obtained from the chance wheel 12 would be substituted for "x" in the exponential function $N^x$ written in the space. However, the resulting value would be subtracted from the score. For example, if a player landed on a space that said "deAMPLIFY $2^x$, then the value "9"would be substituted for "x" and the player would receive a score of $-2^9$=−512. The value of "−512" would then be entered onto the AMPLIFICATION POINTS SCORE CARD 94 (FIG. 5).

If a player were to land upon a "REPLICATE" space 82 on the game board 70 (FIG. 3), then the numerical value obtained from the chance wheel 12 would be doubled and the resulting value entered onto the AMPLIFICATION POINTS SCORE CARD 94 (FIG. 5). Additionally, the triplet codon sequence 46 that was written in the first three boxes of the DNA SEQUENCE SCORE CARD 90 (FIG. 4) would be repeated in the second three box set on the DNA SEQUENCE SCORE CARD 90. For example, if the triplet codon sequence 46 obtained from the chance wheel 12 was "GCG" then "GCGGCG" would be entered into six consecutive spaces on the DNA SEQUENCE SCORE CARD 90.

If a player were to land upon a "BONUS SPIN" space 84 on the game board 70 (FIG. 3) then the player would be able to spin the rotating arrow 60 located in the center of the chance wheel 12. Upon spinning the rotating arrow 60, the arrow will come to a stop and indicate a DNA restriction enzyme name 62 with a corresponding restriction enzyme sequence 64. The player then enters the restriction enzyme sequence 64 onto the DNA SEQUENCE SCORE CARD 90 (FIG. 4). The player's score to be entered onto the AMPLIFICATION POINTS SCORE CARD 94 (FIG. 5) is the numerical value associated with the restriction enzyme sequence 64 multiplied by the arbitrary number ten. For example, in the shown embodiment, the rotating arrow 60 is pointing at "Xba I" which has an enzyme sequence 64 equal to "TCTAGA". The value of this enzyme sequence is shown as "14". As a result, the player would enter "TCTAGA" onto the DNA SEQUENCE SCORE CARD 90 (FIG. 4) and the player's score would be 14×10=140. Additionally, landing on the "BONUS SPIN" space 84 may also give the player a second chance to spin the chance wheel 12 before his/her turn ends.

When a player spins the chance wheel 12, the possibility exists that the indicator arrow 55 will not stop on an amino acid icon 40 but rather will stop on a STOP icon 50 or a primary building block letter 20, 22, 26, 28. If the chance wheel 12 lands on a STOP icon 50, the associated triplet codon sequence is recorded on the DNA SEQUENCE SCORE CARD 90. No points are obtained unless the player is on an "AMPLIFY" space 85 or a "deAMPLIFY" space 86, wherein the value zero is placed into the exponential function associated with those spaces. For instance, if the exponential function on an "AMPLIFY" space 85 is $3^x$ by substituting zero for "x" it can be seen that $3^0$=1, which becomes the player's score.

At the end of the twenty five spins, the players add all the positive and negative values on the AMPLIFICATION POINTS SCORE CARD 94. The winner of the game is the person who has the longest DNA sequence on the DNA SEQUENCE SCORE CARD 90 with the least number of STOP codon sequences (i.e. TAA, TAG, TGA). If there is a tie, the player with the highest point value on the AMPLIFICATION POINTS SCORE CARD 94 wins.

Figure 6:
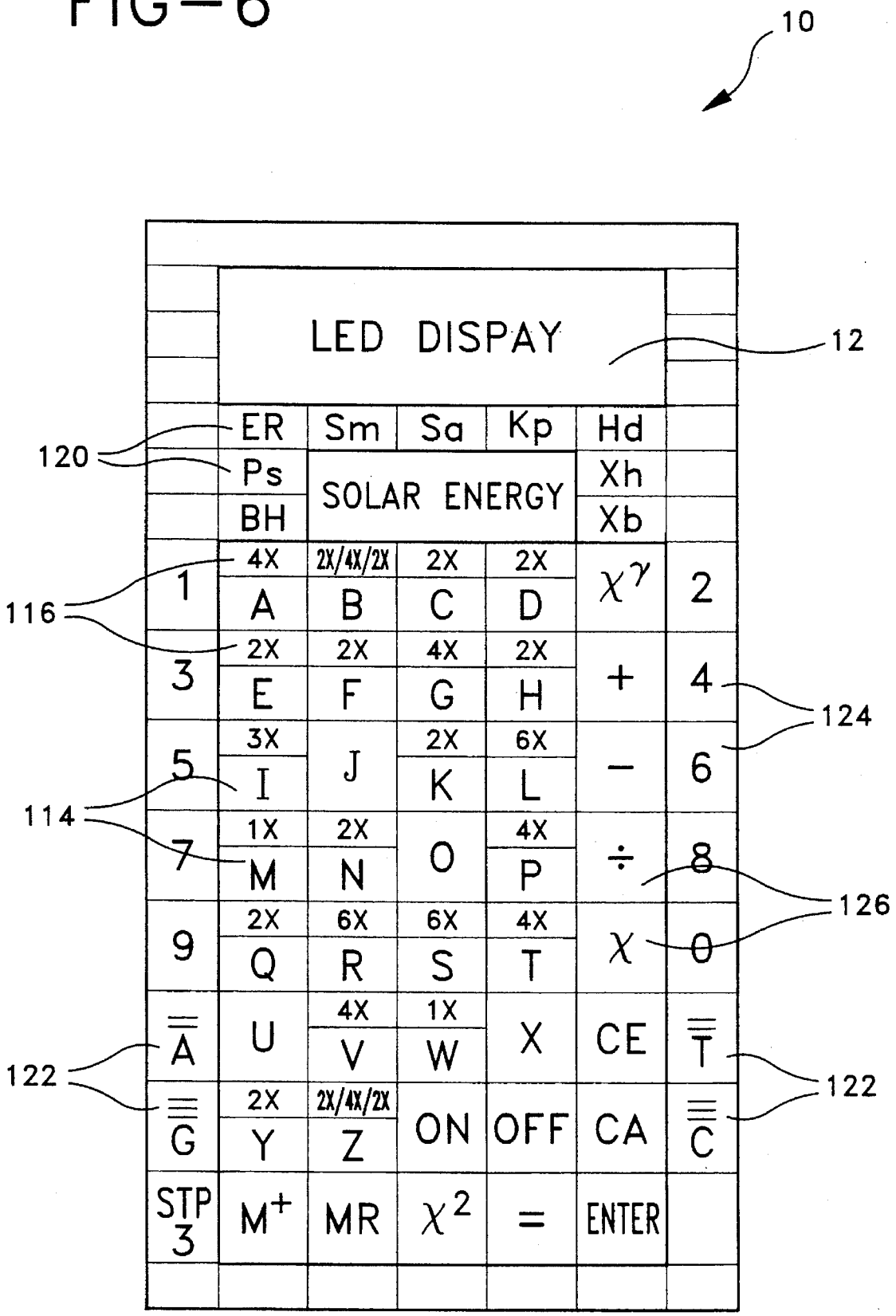
FIG. 6 is a top view of a hand held computer that can optionally be used in the method of play to genetically identify players, simplify calculations and simplify chart references.

The reading on the fine print on the chance wheel 12 may be tedious during play. As such, the present invention may be optionally provided with a small hand held computer to facilitate play of the game. Referring to FIG. 6, a preferred embodiment of the hand held computer 110 is shown. The hand held computer 110 has an LCD display 112. Primary on the keypad of the computer 110 are letter keys 114. There are twenty-six letter keys 114, twenty-two of which correspond to a letter of the alphabet and also to one of the amino acids listed in Table I and present on the chance wheel. The remaining letter keys 144 correspond to DNA restriction enzymes. Some of the letter keys 114 have a multiplication value 116 associated therewith. The multiplication value 116 indicates how many triplet codon sequences there are for the amino acid associated with that letter. For example, the letter A has a multiplication value of "4*x*". This indicates that the amino acid identified by the letter A has four triplet codon sequences. This is also shown in Table I. During play, when a player spins the chance wheel and selects an amino acid icon, the letter stated on the icon can be entered into the hand held computer 110. The computer can then show the player the full name of the amino acid selected and can automatically register the numerical value associated with that amino acid. The computer 110 can also be used by the players to generate DNA sequences that correspond to the player's names. The player then can be identified by his/her DNA sequence during the coarse of the game. For example, if a players name is "JOHN" the player would enter the letters J-O-H-N into the computer 100. For each letter a DNA sequence is generated, thus each name would produce its own unique DNA sequence.

The hand held computer 110 also includes enzyme keys 120 that correspond to the enzymes listed on the inner circle of the chance wheel. If the player must select an enzyme, the numerical value corresponding to that enzyme as well as information about where that enzyme cuts DNA can be displayed on the computer 110 by pressing the appropriate button.

The hand held computer 110 has keys 122 that correspond to building block positions ("A", "T", "G", "C") on the chance wheel. Furthermore, numerical keys 124 and mathematical function keys 126 are provided to facilitate the calculations of math needed to play the game and configure the score on the AMPLIFICATION POINTS SCORE CARD 94 (FIG. 5).

Method of Play No. 2

In a second method of play, players can use the game apparatus to conduct mock DNA testing in order to find a "SUSPECT". The "SUSPECT" could be any person or thing identifiable by its genetic finger print. The "SUSPECT" could be a criminal, a genetic disease, an environmental pollutant or an alien microbe. In this version of the game, the players are provided with a suspect list such as that shown in FIG. 7. In FIG. 7, it can be seen that the suspect list 200 lists ten "SUSPECTS". Each "SUSPECT" has a corresponding amino acid sequence that identifies the suspect. In the suspect list 200, some of the suspects, such as #4, #5, #6 and #10 have truly unique amino acid sequences. Some of the other suspects, such as suspects #1 and #7 or suspects #2 and #8 may differ at only one or two points in the amino acid sequence.

To play the game, each player is given a DNA SEQUENCE SCORE CARD 90 (FIG. 4). Each player then spins the chance wheel 12 (FIG. 1) and enters the one letter code 42 associated with the amino acid icons 40 on the chance wheel 12. If the chance wheel 12 stops on a STOP icon 50, the player loses his/her turn. The first player to make a match of one of the "SUSPECTS" listed in the suspect list 200 wins the game. Alternatively, when a player matches the DNA sequence of one of the "SUSPECTS" on the suspect list 200, the player may receive a reward. The game may then be replayed and the player with the most point rewards at the end, wins.

In method of play number 2, previously described, players use the game apparatus to conduct mock DNA testing in order to find a "SUSPECT". Upon finding a DNA match with a "SUSPECT" the players receive a reward. In on version of the game, the reward could be paid in play money, wherein the monetary value of the reward corresponds to molecular weights of different nucleotides. In such a game motif, the "SUSPECT" would have a known DNA sequence such as 5'-ATG CTT ACC GTA TTG GAA TC-3'. If a player the matches the DNA sequence, the player would receive play money corresponding to the different nucleotides contained within the DNA sequence. In the given example, there are five dA nucleotides, four dG nucleotides, four dC nucleotides and seven dT nucleotides. dA nucleotides have a molecular weight of 313.21 g/mol. As such, in the example the player would receive five pieces of dA play money, each having a value of $313.21. Similarly, since dG nucleotides have a molecular weight of 329.21 g/mol, the pieces of dG play money would have the value of $329.21 g/mol. The play money of the dC and dT nucleotides would also have a value that would correspond to their molecular weight. At the end of the game, the player with the most play money wins.

In yet another embodiment of the present invention game, the use of icon bearing triplet codon sequences 46 (FIG. 1) can be replaced with icons displaying a different distinguishing aspect of a DNA sample such as molecular weights, fragment size or the like. Certain DNA testing procedures do not rely upon exact sequencing within the DNA sample, but rather depend upon the molecular weight of a given DNA sequence or the size of the DNA fragment. As a result, the various icons can be replaced by icons that express molecular weight, fragment size and the like. Similarly, amino acid codons and DNA restriction enzymes sequences can be replaced with nucleotides and the like in various forms that employ nucleic acid probes, fragments, antibodies and any other variable by which a DNA sample may be distinguished.

It will be understood that many variants of DNA-based games can be played using the various game elements that have been described. It should further be understood that a key element in each variant of the game is the ability to randomly select a feature of a DNA sample that can be used to distinguish that sample, such as a codon sequence, molecular weight and the like. In the embodiments described, a chance wheel (FIG. 1) was used to randomly select the various amino acids. However, such an embodiment is merely exemplary and many other biotechnology related motifs and random selection devices could be used. For instance, the chance wheel could be formed as a roulette wheel wherein a ball would randomly land on the various spaces. Similarly, the information contained on the wheel could be incorporated onto a dart board, wherein the placement of a dart or other indicator (i.e. laser point) could be used to select the various amino acids. Perhaps the two simplest ways, other than the chance wheel, to randomly select DNA related information would be through the use of playing cards or computer software. If cards were used, a card could be printed for every playing space on the chance wheel. The cards could then be shuffled and selected by players, thereby giving the same effect as the chance wheel. In a computer software application, the various information could be stored in memory and randomly displayed when the computer is prompted by a player. This also provides the same effect as the chance wheel.

A person skilled in the art could select numerous random selection devices for use in place of the described chance wheel. Furthermore, many different game motifs can be created around a game uses DNA related technologies such as those described. All such modifications and variations are intended to be included in the scope of the present invention as defined by the appended claims.

What is claimed is:

1. A game apparatus for teaching DNA related technologies, comprising:

selection means for repeatedly selecting at least one nucleotide from a first plurality of nucleotides; and recording means for repeatedly recording said at least one nucleotide selected by said random selection means, thereby producing a nucleotide sequence.

2. The game apparatus according to claim 1, wherein said first plurality of nucleotides are selected from a group consisting of amino acid codons, SENSE codons, ANTI-SENSE codons, restriction enzyme sequences and DNA sequence fragments.

3. The game apparatus according to claim 1, further including a second selection means for selecting at least one second nucleotide from a second plurality of nucleotides, wherein each said second nucleotide is added to said random nucleotide sequence by said recording means.

4. The game apparatus according to claim 1, wherein a numerical value is associated with each of said first plurality of nucleotides.

5. The game apparatus according to claim 4, further including a second recording means for repeatedly recording said numerical value associated with said nucleotide selected by said selection means.

6. The game apparatus according to claim 4, further including a game board wherein said game board contains spaces that require that a predetermined mathematical function be performed on said numerical value prior to said numerical value being recorded by said second recording means.

7. The game apparatus according to claim 1, wherein said selection means includes a display of said first plurality of nucleotides and a means for choosing said at least one nucleotide from said display.

8. The game apparatus according to claim 7, wherein said display includes a plurality of distinct icons, each of said icons having at least one of said plurality of nucleotides displayed thereon.

9. A game apparatus comprising a plurality of amino acid icons, wherein each of said amino acid icons indicates a first genetic sequence unique to that amino acid icon;

a plurality of STOP icons, wherein each of said STOP icons indicates a second genetic sequence unique to that STOP icon; and a first selection means for enabling a player to randomly select from among said amino acid icons and said STOP icons.

10. The game apparatus according to claim 9 further including a plurality of enzyme icons, wherein each of said enzyme icons indicates a third genetic sequence unique to that enzyme icon.

11. The game apparatus according to claim 10 further including a second selection means for enabling a player to randomly select from among said enzyme icons.

12. The game apparatus according to claim 10 further including a means for selectively recording said first genetic sequence, said second genetic sequence and said third genetic sequence, thereby forming one long DNA sequence.

13. The game apparatus according to claim 9, wherein each of said amino acid icons further indicates a one letter code, a three letter code and a numerical value.

14. A method of playing a game, comprising the steps of:

(a) randomly selecting at least one nucleotide from a plurality of nucleotides;

(b) recording said at least one nucleotide;

(d) repeating steps (a) and (b) to produce a nucleotide sequence.

15. The method according to claim 14, further including the steps of assigning a numerical value to said at least one nucleotide and totaling said numerical value for said nucleotide sequence.

16. The method according to claim 14, wherein said step of selecting an amino acid includes the substeps of displaying said plurality of nucleotides and utilizing a selection mechanism that randomly selects from among said plurality of plurality of nucleotides.

17. The method according to claim 14, further including the step of comparing said nucleotide sequence to a plurality of predetermined DNA sequences in order to find a match therebetween.

18. The method according to claim 14, wherein said step of selecting a nucleotide from a plurality of nucleotides includes identifying said nucleotide by its molecular weight.

* * * * *